United States Patent [19]

Eisenhuth

[11] 4,434,571

[45] Mar. 6, 1984

[54] DEVICE FOR LUBRICATING MUZZLE-LOADING BULLETS AND METHOD FOR HANDLING AND LOADING THE BULLETS

[76] Inventor: Warren V. Eisenhuth, 113 Dorchester Dr., Vincentown, N.J. 08088

[21] Appl. No.: 404,568

[22] Filed: Aug. 2, 1982

[51] Int. Cl.[3] ..... F41C 27/00

[52] U.S. Cl. ..... 42/90; 86/19

[58] Field of Search ..... 42/90; 86/19; 184/14

[56] References Cited

U.S. PATENT DOCUMENTS 4,108,044 8/1978 Brown ..... 86/19
4,254,572 3/1981 Nelson ..... 42/90
4,353,282 10/1982 Holt ..... 42/90
4,384,424 5/1983 Fowler ..... 42/90
4,393,613 7/1983 Knosky ..... 42/90

*Primary Examiner*—Charles T. Jordan
*Attorney, Agent, or Firm*—Thomas A. Lennox

[57] ABSTRACT

A device and method for lubricating muzzle-loading bullets is provided, including a cylindrical chamber of special diameter allowing a portion of the bullet to be inserted, sealing off the grooves in the bullet to be lubricated, and a plunger piston system to hold and then eject the bullet into a flexible cylindrical tube wherein the bullet may be stored and then ejected into the muzzle of the rifle.

6 Claims, 4 Drawing Figures

DEVICE FOR LUBRICATING MUZZLE-LOADING BULLETS AND METHOD FOR HANDLING AND LOADING THE BULLETS

BACKGROUND OF THE INVENTION

This invention relates to a hand held device for lubricating muzzle-loading bullets and a method for storage and loading the lubricated bullets.

In particular, this invention is directed to muzzle-loading firearms and, in particular, to those bullets designed for use in muzzle-loading rifles. In order to utilize the rifling in the barrel, the front end of the bullet is of a diameter such that when the bullet is forced into the muzzle, this front ring portion of the bullet is scored and the bullet follows the rifling down the barrel as it is forced to the powder charge. When the powder is discharged, the bullet follows the rifling imparting the highly desirable rotation necessary for high accuracy fire. A common construction for many muzzle-loading bullets have a front ring with a larger diameter than the rear of the bullet which generally includes two or more additional rings of lesser diameter. Some of the bullets have a front ring with a reduced diameter immediately to the rear after which the diameter of the bullet increases until the rear of the bullet is almost the diameter of the front ring. For the purpose of this invention this shape and all shapes that form grooves are considered to have at least two rings even though they are widely separated. This shape forms a groove and all the varied shapes form one or more grooves along the length of the bullet. These grooves are designed to receive the lubricant necessary to ease loading and firing the rifle. The difference between the diameter of the front ring and the diameters of the rear rings usually ranges from about three thousandths of an inch. A lubricator-loader for firearms is described in U.S. Pat. No. 4,254,572 to Henry R. Nelson. An additional device for greasing muzzle-loading bullets is described in U.S. Pat. No. 4,108,044 to Richard Brown. An apparatus for lubricating and sizing slugs is described in U.S. Pat. No. 3,967,526 to Robert A. Leich. An older device and method for sizing and lubricating bullets is described in U.S. Pat. No. 2,403,032 to William G. Stevens, Jr.

The present invention of the lubricating device and the method of lubrication handling and loading of the bullet, allows the lubrication of the bullets in a fashion that does not damage the bullets, but yet allows the grooves to be filled with lubricant without getting lubricant on the rear of the bullet where the powder may be affected.

Difficulties with prior lubrication systems and devices include that the hand-held devices get grease on the hands, are difficult to handle in the field and do not provide for prior lubrication and storage before firing.

It is an object of this invention to provide a lubricating device that lubricates the grooves but does not get lubricant on the rear end of the bullet which tends to contaminate the powder charge.

It is also an object of this invention to provide a lubricating device capable of handling the proper lubricant most desirable for lubricating the muzzle-loading bullets.

It is a further object of this invention to provide a lubricating device that avoids marking the front ring of the bullet in any way, or damaging the rings of the bullet, which allows powder leaking and loss of accuracy during discharge.

It is a further object of this invention to provide a lubricating device that will grease all rings of the bullet at the same time and it is not necessary to be taken apart each time the lubricator is used.

It is a further object of this invention to provide a method of storage of greased bullets prior to use, thus mostly avoiding greasing in the field.

It is an additional object of this invention to protect the greased bullets, keeping them clean and free of abrasive contamination prior to firing.

It is a further object of this invention to provide a lubricating device that may be used in the field and reduces the possibility of getting grease on the hands during the lubricating process.

It is a further object of this invention to provide a lubricating device which allows the muzzle-loading bullet to seat in the device and essentially prevent leakage, when held by the hand.

It is a further object of this invention to provide a method of transfer, holding and loading of the bullet from the lubricating device to the muzzle of the rifle, wherein at each step there is little possibility of getting grease on the hands or on the rifle.

None of the devices described above satisfy these objects and the needs for this device and method. The following device and method satisifies these objects as follows.

SUMMARY OF THE INVENTION

This invention is a device for lubricating muzzle-loading bullets having a front ring near the nose or forming the front end of the bullet, and at least one rear ring forming at least one groove to be filled with lubricant. Typically, and preferably, the bullets have two or more rings, thus forming lube grooves between the rear rings and the nose ring of the bullet. As noted above, many bullets are designed that the front ring is of slightly larger diameter to allow the rifling in the bore of the rifle to score only this front ring or bearing or band of the bullet as it is forced into the muzzle. The device includes a housing body and a cylindrical chamber opening one end of the body with the chamber terminating at a rear end in the body. The depth of the chamber from the open leading edge to the rear end is longer than the distance from the rear edge of the nose ring to the base end of the longest bullet to be inserted in the chamber. The diameter of the chamber opening is large enough to allow the rear ring or rings of the bullet to push fit into the chamber, that is a sliding but close tolerance, but small enough to prevent any larger diameter front ring from entering the chamber. Preferably, the leading edge of the cylindrical chamber opening is slightly beveled to allow the nose ring rear edge of the bullet to seat against the beveled edge. A lubrication entrance port device is provided in the body to receive the lubricant. A lubrication charging chamber distribution device is located in the body providing flow communication with the port device and groove or grooves in the bullet when it is placed in the cylindrical chamber. A plunger piston device is attached in the body located at the rear end of the cylindrical chamber capable of moving against the base end of the bullet during lubrication and of pushing and ejecting the lubricating bullet from the chamber opening.

The invention includes a method of lubricating muzzle-loading bullets as described above, including inserting a bullet into the device described hereinabove. After the bullet is placed in the chamber it is held in place in the chamber, by placing hand pressure against the bullet head and against the plunger piston means. The method includes injecting lubricant into the entrance port under pressure to fill the chamber distribution device and ultimately fill grooves of the bullet. After the bullet is lubricated a flexible cylindrical tube is placed over the head of the bullet and the plunger piston device is used to eject the bullet into the tube. The bullet is stored until it is ready for use and loading. To load, the open end of the flexible tube is placed against the muzzle of the rifle. Pressure on the flexible tube near the head of the bullet causes it to eject directly into the muzzle ready to be seated.

DESCRIPTION OF PREFERRED EMBODIMENTS

Figure 1:
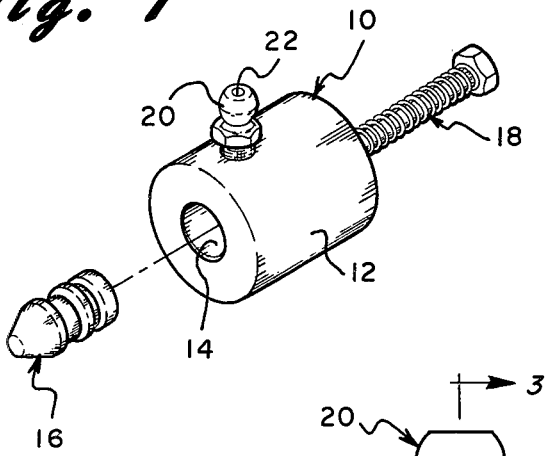
FIG. 1 is a perspective view illustrating the lubricator device of this invention with a muzzle-loading bullet in alignment to be placed into the lubricating device.
Figure 2:
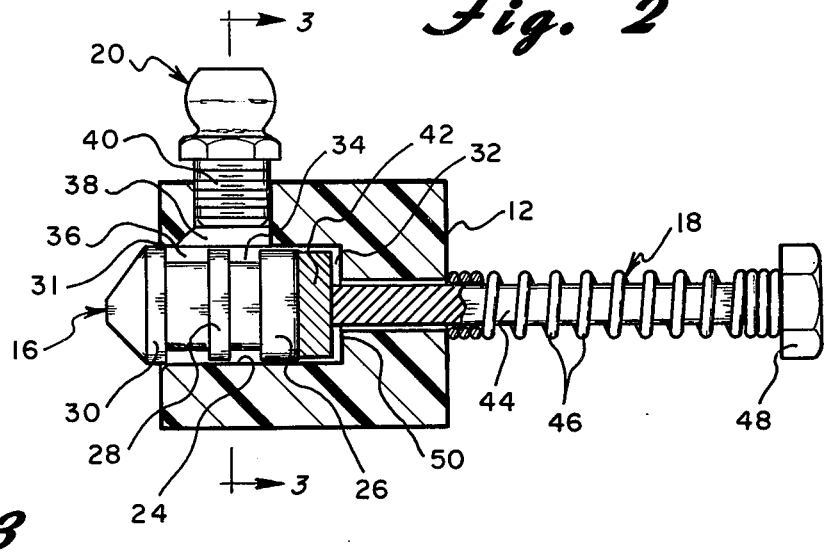
FIG. 2 is a partial cross-sectional view taken along a horizontal plane of the body of the lubricating device pictured in FIG. 1 with the bullet shown in place in the partial cross-section.

Lubricator device 10 is illustrated in the perspective view of FIG. 1. Although a MAXI-BALL bullet (trademark of Thompson Center) is illustrated to be inserted into chamber opening 14 of body housing 12 of lubricator device 10, essentially all muzzle loading bullets may be used. The body housing 12 is metal or plastic and may be machined of an aluminum cylinder to which lubrication nipple device 20 is attached to allow lubricant to be injected into lubrication port 22. A plunger-piston device 18 is provided to eject the MAXI-BALL 16 after lubrication. The partial cross-sectional view of FIG. 2 is taken along the vertical center line plane through housing 12 to illustrate the internal configuration of lubricator device 10. The MAXI-BALL 16 is shown inserted seated in place in cylindrical chamber 24, the diameter of which is critical. The diameter is chosen to allow rear ring 26 and middle ring 28 to be push fitted into chamber 24, but is also chosen to be small enough to prevent front ring 30 of MAXI-BALL 16 from insertion into the chamber. In this example the diameter is about one thousandth of an inch larger than the rear rings of the MAXI-BALL. The rear corners of front ring 30 rest on beveled corners 31 on the outer corners of chamber opening 14. Thus, when MAXI-BALL 16 is fully inserted as far as it will go, the length of the bullet from the back edge of front ring 30 to the rear end of the bullet does not fill chamber 24. Although the rear end of bullet 16 is shown against plunger piston 42, the plunger has been moved as described later. Play distance 32 is important to allow the rear edge of nose ring 30 to seat against beveled edge 31 of chamber 24 opening. With bullet 16 in place, rear lube groove 34 and front lube groove 36 may be completely filled with grease pushed into the chamber through grease charging chamber 38 from lubrication nipple 20. Grease charging chamber 38 is in closed pressure communication with the bullet grooves 34 and 36 and the grease is forced under pressure to fill the grooves. Lubrication nipple 20 is connected into body housing 12 in a sealable fit. Plunger piston 42 is a metal or plastic cylinder structurally attached to rod plunger 44, wherein the fit and seal of the sides of piston 42 in chamber 24 bore is tight, such that any grease squeezing past ring 26 is essentially prevented from passing piston 42. For illustration purposes, the diameter of piston 42 is shown smaller than ring 26, but in actual construction both diameters are preferrably chosen to provide a push fit. The front surface of piston 42 engaging the back of bullet 16 is prepared so as to prevent any grease from reaching the base end surface of the bullet. Coil spring 46 provides compression against the exterior rear of housing 12 against bolt stop 48 to force plunger piston 42 against end 50 of cylindrical chamber 24. By holding pressure between the bullet head and stop 48, the bullet is held in position during greasing. When bullet 16 has been fully greased, plunger stop 48 is pushed to move plunger piston 42 outwardly in chamber 24 to eject bullet 16.

Figure 3:
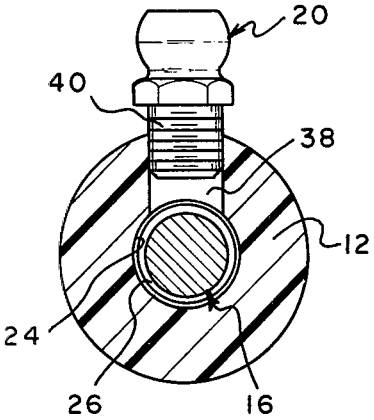
FIG. 3 is a partial cross-sectional view taken along lines 3—3 of FIG. 2.

A cross-sectional view is illustrated in FIG. 3 taken along lines 3—3 of FIG. 2 to show the shape of grease charging chamber 38 in communication with lubrication nipple 20 and chamber 24.

Figure 4:
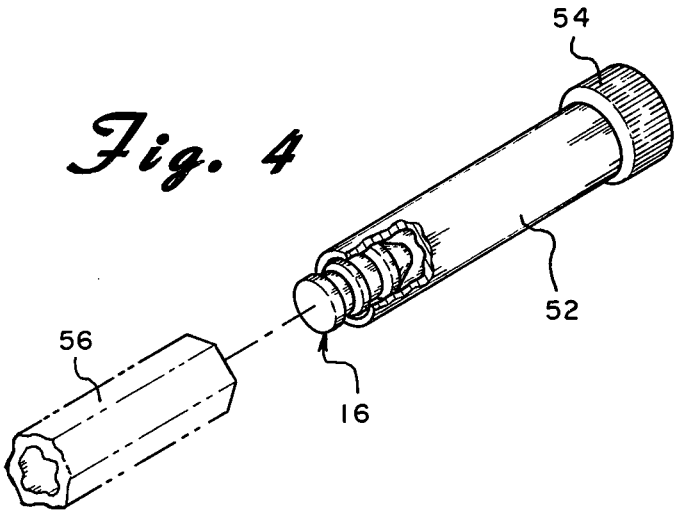
FIG. 4 is a perspective view with a partial cut-out showing the bullet held in the end of the flexible tube ready to be inserted into the rifle muzzle.

In FIG. 4, the method of this invention after the above steps have been taken is illustrated in a perspective view. When piston device 18 is used to eject bullet 16, it is injected directly into flexible tube 52 which is equipped with press fit closure 54. Normally, the bullets are stored for use in the field so that a second closure, not pictured, is used to close off the near end of tube 52. Although one bullet is shown in tube 52 it is expected that more than one may be stored in a single tube. When the muzzle loading rifle is to be loaded flexible tube 52 is squeezed near the front end of bullet 16 moving it out the open end and directly into gun barrel 56 into which it is seated in standard fashion.

While certain materials of construction have been mentioned above, it should be understood that the various parts may be constructed of metal or plastic such as the "engineering" type of thermoplastic polymeric plastics.

While this invention has been described with reference to the specific embodiments disclosed herein, it is not confined to the details set forth and the patent is intended to include modifications and changes which may come within and extend from the following claims.

I claim:

1. A device for lubricating muzzle-loading bullets, having a front ring and at least one rear ring forming at least one groove to be filled with lubricant, the device comprising:

(a) a housing body, (b) a cylindrical chamber opening one end of the body and terminating at a chamber end in the body, wherein the depth of the chamber to the end is longer than the distance from the front ring to the base of the longest bullet to be inserted into the chamber, and wherein the diameter of the chamber opening is large enough to allow the rear ring or rings to push fit into the chamber but small enough to prevent the front ring from entering the chamber, (c) a lubrication entrance port means in the body to receive lubricant (d) a lubrication charging chamber distribution means in the body in flow communication with the port means and the groove or grooves in the bullet, when it is placed in the cylindrical chamber, (e) a plunger piston means attached in the body located at the end of the cylindrical chamber, capable of moving against the base end of the bullet during lubrication and of pushing and ejecting the lubricated bullet.

2. The device of claim 1 wherein the open leading edges of the cylindrical chamber are beveled.

3. The device of claim 1 wherein the plunger piston means comprises a plunger piston in the rear end of the cylindrical chamber structurally attached to a rod plunger, extending outside the body on the central axis of the chamber, with an end stop springably loaded to pull the plunger piston against the rear end of the cylindrical chamber.

4. The device of claim 1 wherein the lubrication charging chamber distribution means is a chamber extending transversely along a sufficent distance along the length of the cylindrical chamber, to allow opening to grooves in a bullet inserted in the cylindrical chamber.

5. The device of claim 4 wherein the lubrication charging chamber extends along the length of the cylindrical chamber a distance, to allow opening to all the grooves in a bullet inserted in the cylindrical chamber.

6. A method for lubricating muzzle loading bullets having at least one groove to be filled with lubricant and loading the firearm comprising:

(a) inserting a bullet into the device described in claim 1, (b) placing hand pressure against the bullet head and against the plunger piston means holding the bullet in position, (c) injecting lubricant into the lubrication entrance port under pressure to fill the lubrication distribution means and to fill the grooves of the bullet, (d) placing a flexible cylindrical tube over the end of the protruding bullet, (e) pushing the plunger means to eject the bullet into the flexible tube, (f) storing the bullet in the tube until ready for use, (g) placing the open end of the flexible tube against the muzzle of the rifle, and (h) squeezing the flexible tube to eject the bullet into the muzzle.

* * * * *